United States Patent [19]

Ambrosat et al.

[11] 4,192,447

[45] Mar. 11, 1980

[54] MULTI-COMPARTMENT ENVELOPE

[75] Inventors: Ernest O. Ambrosat; Arthur Weingartner, both of Hickory Hills, Ill.

[73] Assignee: Victor Envelope Company, Elmhurst, Ill.

[21] Appl. No.: 901,433

[22] Filed: May 1, 1978

[51] Int. Cl.[2] ..... B65D 27/08

[52] U.S. Cl. ..... 229/72; 150/32; 150/39

[58] Field of Search ..... 229/72, 56, 68 R, 53; 150/30, 32, 39, 1; 206/260

[56] References Cited

U.S. PATENT DOCUMENTS

| | | | |
|---|---|---|---|
| 1,860,965 | 5/1932 | Stone | 229/53 X |
| 2,344,369 | 3/1944 | Salfisberg | 229/53 |
| 2,668,769 | 2/1954 | Schlienz | 150/1 X |
| 3,129,872 | 4/1964 | Lutwack | 229/72 |
| 3,323,708 | 6/1967 | Nesbit | 229/72 |
| 3,345,793 | 4/1944 | Chapel | 229/68 R |
| 3,394,870 | 7/1968 | Curtis | 229/56 |
| 3,460,744 | 8/1969 | Turkenkopf | 229/72 |
| 3,933,294 | 1/1976 | Meenan et al. | 229/72 |
| 3,979,051 | 9/1976 | Close | 229/72 |

*Primary Examiner*—Stephen P. Garbe

*Attorney, Agent, or Firm*—Thomas W. Speckman

[57] ABSTRACT

Multi-compartment envelopes and process for their manufacture from a single sheet by folding one end portion of the sheet over adjacent the medial portion of the sheet, then folding the opposite end portion of the sheet over adjacent the first end portion, securing the side edges together and cutting open the first fold forming an opening to a first pocket, the second pocket having its opening between the end of the sheet and the front panel of the first pocket. The envelopes may provide different sized pockets particularly suited for use of storage of medical x-rays in one pocket and records and information in a second pocket.

8 Claims, 4 Drawing Figures

MULTI-COMPARTMENT ENVELOPE

This invention relates to multi-compartment envelopes which may be fabricated from a single sheet of material. The envelopes of this invention are particularly suited to use for storage of medical x-rays in one pocket and other papers such as patient's records and information in a second pocket. The process for production of a multi-compartment envelope from a single elongated sheet according to this invention, simplifies prior production methods.

Previously, multi-compartment envelopes were fabricated by adhering two side edges and the bottom edge of a rectangular sheet to the front panel of an envelope to form a second pocket. More than the desired number of failures occurred as a result of tearing the front pocket along the glue lines. One attempt to decrease such failures is the multi-compartment envelope as disclosed in U.S. Pat. No. 3,979,051. However, the envelope taught by that patent requires handling of a second sheet and careful and accurate positioning of the two sheets during envelope manufacture.

It is an object of this invention to provide a multi-compartment envelope and a process for its manufacture overcoming the above disadvantages.

Another object of this invention is to provide a multi-compartment envelope fabricated from a single sheet.

Yet another object of this invention is to provide a high strength, two compartment envelope requiring securement only at the side edges.

It is another object of this invention to provide a two compartment envelope wherein the securement of each side edge is obtained by a side flap from the back panel folded over and adhesively secured to the front panel of each of the two compartments.

It is yet another object of this invention to provide a recess in each side flap permitting wider opening of the second pocket.

Other objects and advantages of the invention will become apparent from the following description taken in conjunction with the accompanying drawings showing preferred embodiments wherein.

Figure 1:
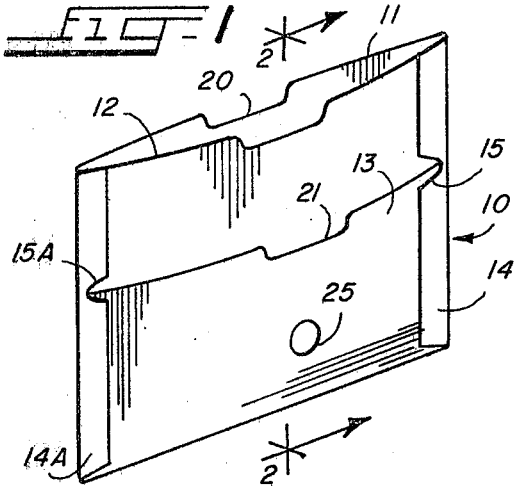
FIG. 1 is a perspective view of a two compartment envelope according to one preferred embodiment of this invention.

FIG. 1 shows multi-compartment envelope 10 having a back panel 11, front panel 12 and front compartments 13 forming a first pocket between back panel 11 and front panel 12 and a second pocket between front panel 12 and front compartment panel 13. The side edges of the front compartment panel 13, front panel 12 and back panel 11 are secured by side flaps 14 and 14A with adhesive on their rear sides adhering to front compartment panel 13 and front panel 12, as shown. Side flaps 14 and 14A are folded from the side edges of back panel 11. The side flaps may have side flap recesses 15 and 15A in the region of the top of front compartment panel 13 providing wider opening of the second or front pocket. The top of the first or main compartment may have main compartment notch 20 and the top of the front compartment may have front compartment notch 21 to render more ready access to the contents of each pocket. Viewing aperture 25 may be provided through front compartment panel 13 or front compartment panel 13 and front panel 12, or through all three panels to provide a ready means for determination of whether anything is contained within the pockets. It is readily apparent that multiple viewing apertures may be located across the width of the envelope to ascertain the inclusion of smaller objects within the envelope.

Figure 2:
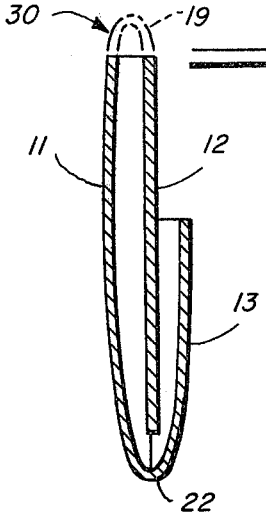
FIG. 2 is a sectional view taken along line 2—2 as shown in FIG. 1.

FIG. 2 shows more clearly the fabrication of the multi-compartment envelope shown in FIG. 1 from a single sheet. It is seen that front panel 12 is formed from the first end portion of a single sheet in which back panel 11 forms the medial portion and front compartment panel 13 forms the second end portion. The front and back panels are substantially the same size, the front panel being up to 1 to 1½ inches shorter than the back panel. Thus, the multi-compartment envelope from a single elongated sheet is formed by folding the first end portion of the sheet over adjacent the top surface of the medial portion forming a first or top fold 19 and then the second end portion is folded over adjacent the bottom surface of the first end portion forming bottom fold 22. The side edges of back panel 11, front panel 12 and front compartment panel 13 are secured at the edges and top fold 19 is cut open forming top cutoff section 30 providing an opening to a first pocket between back panel 11 and front panel 12.

Any suitable side securing means which secures together the side edges of the front compartment, front and back panels is satisfactory. Various metallic or plastic securing means may be used along the side edges and in cases where the front surface of the front panel and front compartment panel are not exposed, it is necessary that the securing means provide internal means of holding the non-exposed panels, such as by pins, staples and the like. In one preferred embodiment of a two compartment envelope, it is desired that the front compartment be smaller than the main compartment and therefore, a portion of the front surface of each the front panel and front compartment panel are exposed. In such cases, it is preferred that the side securing means be side flaps from the back panel folded over and adhesively secured to the front compartment panel and the front panel as shown in FIG. 1. Any suitable adhesive or contact cement may be placed on the face of the side flaps coming into contact with the front and front compartment panels.

Figure 3:
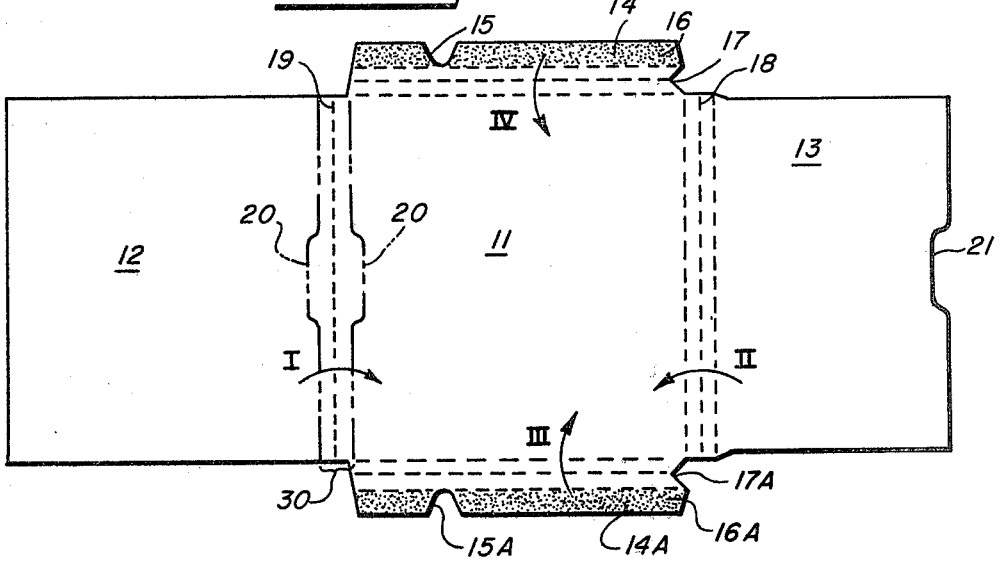
FIG. 3 is a plan view of a single sheet for production of a two compartment envelope according to another embodiment of this invention.
Figure 4:
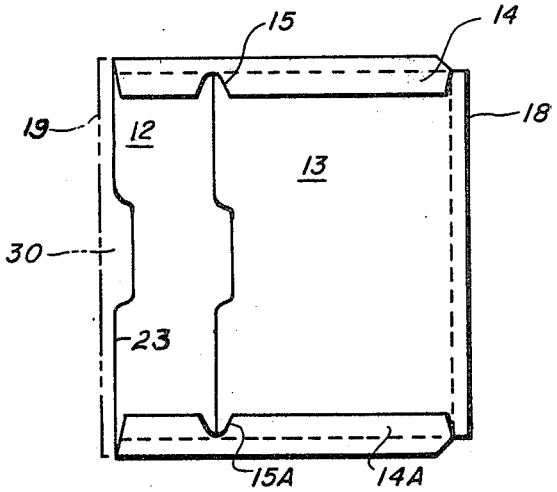
FIG. 4 is a front view of a two compartment envelope produced from the sheet shown in FIG. 3.

FIG. 3 is a plan view of a single sheet for production of a two compartment envelope similar to that shown in FIG. 1 except having expandable folds at the side and bottom to permit greater amounts of material to be stored in the compartments. The process for production of a multi-compartment envelope from a single elongated sheet is readily seen from FIG. 3. In sequence, the first end portion 12 of the sheet is folded over adjacent the top surface of medial portion 11 as indicated by the arrow mark I forming first fold 19. Then, the opposite second end portion 13 of the sheet is folded over adjacent the bottom surface of the first end portion as shown by arrow II forming second fold 18. The side edges of the first end, medial and second end portions are secured by folding side flaps 14 and 14A over and securing to the sides of the first end and second end portions 12 and 13, respectively, as shown by arrows III and IV. The two compartment envelope as shown in FIG. 4 is then formed by cutting open first fold 19 by cutting off top section 30 along line 23 forming an opening to a first pocket between the medial portion and the first end portion. A second pocket is formed between the second end portion and the front panel of the main compartment. As shown in FIGS. 3 and 4, an expandable envelope is provided by forming side expandable folds 17 and 17A and bottom expandable fold 18 by methods well known in the art.

The multi-compartment envelopes according to this invention may be produced from paper, cardboard, plastic or other suitable material.

While in the foregoing specification this invention has been described in relation to certain preferred embodiments thereof, and many details have been set forth for purpose of evaluation, it will be apparent to those skilled in the art that the invention is susceptible to additional embodiments and that certain of the details described herein can be varied considerably without departing from the basic principles of the invention.

We claim:

1. A multi-compartment envelope produced from a single sheet comprising:

an adjacent single sheet thickness front and back panel formed by folding one end of said single sheet over and adjacent a portion of the remainder of said single sheet, said panels secured together at opposing side edges and open at the top by cutting off said fold between said front and back panel forming an opening to the top of a first pocket, the bottom of said front and back panel not being fastened together;

a single sheet thickness front compartment panel folded upwardly from the bottom of said back panel adjacent said front panel and open at the top forming an opening to a second pocket; and side securing means securing closed the side edges of said front compartment, front and back panels.

2. The envelope of claim 1 wherein said front and back panels have substantially the same dimensions.

3. The envelope of claim 1 wherein said front compartment panel is shorter than said front panel forming a second pocket smaller than the first pocket.

4. The envelope of claim 1 wherein said side securing means comprise side flaps from said back panel folded over and adhesively secured to said front compartment panel and front panel.

5. The envelope of claim 4 wherein each said side flap has a recess in the region of the top of said front compartment panel permitting wider opening of said second pocket.

6. The envelope of claim 4 wherein the bottom fold between the back panel and the front compartment panel and the side fold between the back panel and each side flap is an expandable fold.

7. The envelope of claim 1 wherein said front panel is shorter than said back panel.

8. The envelope of claim 1 additionally having a viewing aperture through at least said front compartment panel.

* * * * *